United States Patent [19]

Koopmeiners

[11] 4,102,319

[45] Jul. 25, 1978

[54] FIREPLACE ROOM HEATER

[75] Inventor: Linus J. Koopmeiners, St. Cloud, Minn.

[73] Assignee: The Gran-A-Stone Company, St. Cloud, Minn.

[21] Appl. No.: 741,709

[22] Filed: Nov. 15, 1976

[51] Int. Cl.[2] ..... F24B 7/04

[52] U.S. Cl. ..... 126/121; 237/51

[58] Field of Search ..... 126/121; 237/51; D23/94–97

[56] References Cited

U.S. PATENT DOCUMENTS

| | | | |
|---|---|---|---|
| 1,589,539 | 6/1926 | Marchessault | 126/121 |
| 1,706,768 | 3/1929 | Brewster | 126/121 |
| 1,987,252 | 1/1935 | Cage | 126/121 |
| 2,117,379 | 5/1938 | Turner | 126/121 |

*Primary Examiner*—John J. Camby

*Assistant Examiner*—Larry I. Schwartz

*Attorney, Agent, or Firm*—Orrin M. Haugen; Thomas J. Nikolai

[57] ABSTRACT

A fireplace room heater means comprising a hooded shell for mounting in a fireplace flue and comprising shell means forming an enclosure and with intake and exhaust air manifold chambers formed therein. An inlet port is in communication with the base portion of the intake manifold and an outlet port is in communication with the upper portion of the exhaust manifold, and a plurality of duct means extend across the flue area interposed between the intake and exhaust manifold chambers. The ducts are arranged in rows, with the individual ducts forming the rows being staggered from the individual ducts in adjacent rows, with the ducts extending along an inclined axis from the inlet to the outlet. A top row of ducts extends across and couples the upper end portions of the manifolds, one to another.

2 Claims, 11 Drawing Figures

FIREPLACE ROOM HEATER

BACKGROUND OF THE INVENTION

The present invention relates generally to a fireplace room heater means, and more specifically to a fireplace room heater means which is designed for efficient gravity air flow so as to maintain the surfaces in contact with the hot gases at a reasonably low temperature level. The fireplace room heater means is designed to be mechanically durable, and is further arranged to provide efficient air flow so as to maintain the individual heat transfer surfaces at an effectively lower temperature level. The design of the device of the present invention therefore reduces burning or oxidative losses of the metallic surfaces, and furthermore enhances the flow of air so as to increase the heating efficiency of the system. The heat transfer means are further arranged in stacked and staggered relationships so as to provide minimal impedance to the flow of hot flue gases therearound.

Fireplaces are generally regarded as efficient sources of heat for the interior of a dwelling. For the most part, fireplace flues extract heat from the ambience, and furthermore generally provide thermal gain to the room only through radiation. In many instances, hooded shell means are provided for fireplaces in order to provide some convective heat transfer to the ambience, in addition to the radiation factor mentioned above. Generally speaking, however, the hooded shell means provide little, if any, thermal gain, and may, in certain designs, impede the proper flow of heated gases upwardly through the fireplace flue and outwardly of the stack.

SUMMARY OF THE INVENTION

In accordance with the present invention, a fireplace room heater means is provided which is designed to provide convective heat gain to the room environment, with the convective heat gain being obtained without adversely affecting the performance of the fireplace including draw and the like. The design of the room heater means is such that air flow through the heat exhange surfaces is relatively rapid, thereby reducing the temperature of the surfaces in contact with the hot stack gases, thus effectively reducing certain of the oxidative losses, while experiencing efficient thermal gains in the convective transfer.

In general, the fireplace room heater means of the present invention comprises a hooded shell means which mounts directly in a fireplace flue, with the shell means being in the form of an enclosure with front, rear, and side walls. An open bottom and an open top are provided for the flue segment which the hooded shell means occupies. An intake air manifold and an exhaust air manifold chamber are provided, with duct means being arranged between the manifold chambers and arranged to provide for air flow therebetween. In order to enhance the air flow, the duct means are arranged in a plurality of rows, with the individual members of the rows being offset from individual members in adjacent rows, thereby providing minimal disruption of the normal flow of stack gases. In addition, the axis of the individual ducts is inclined between the intake manifold and exhaust manifold, with the duct axis of the ducts of each of the rows being spaced apart a vertical distance generally equal to twice the outer duct diameter. The top row of ducts extends generally across and couples the upper portions of the manifolds, one to the other, thereby providing and maintaining air flow through substantially the entire portions of the individual manifold chambers.

Therefore, it is a primary object of the present invention to provide an improved fireplace room heater means which enables air flow to occur at a relatively rapid rate, thus providing increased efficiency of convective heating obtained from a fireplace.

It is a further object of the present invention to provide an improved fireplace room heater means which has a large area of exposure to fireplace flue gases, with the design of the room heater means being such that air flow occurs at a rapid rate within the structure, thereby reducing the surface temperature of the areas exposed to the flue gases, and furthermore reducing the interference with normal flow of gases from the firebox through the stack.

Other and further objects of the present invention will become apparent to those skilled in the art upon a study of the following specification, appended claims, and accompanying drawings

DESCRIPTION OF THE PREFERRED EMBODIMENT

Figure 1:
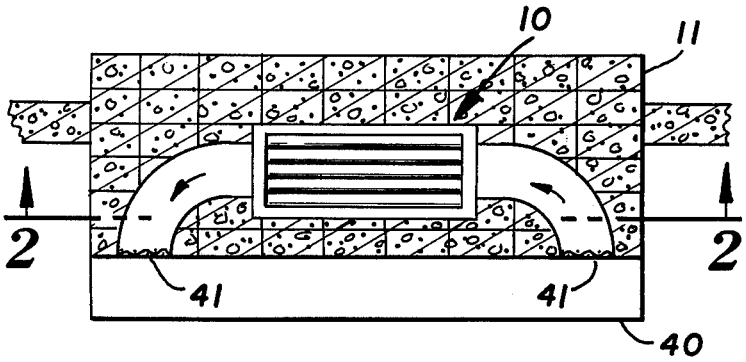
FIG. 1 is a top plan view of a portion of a fireplace structure, and including generally that portion illustrated in FIG. 2, with FIG. 1 illustrating the arrangement of the hooded room heater means within a conventional room fireplace.
Figure 2:
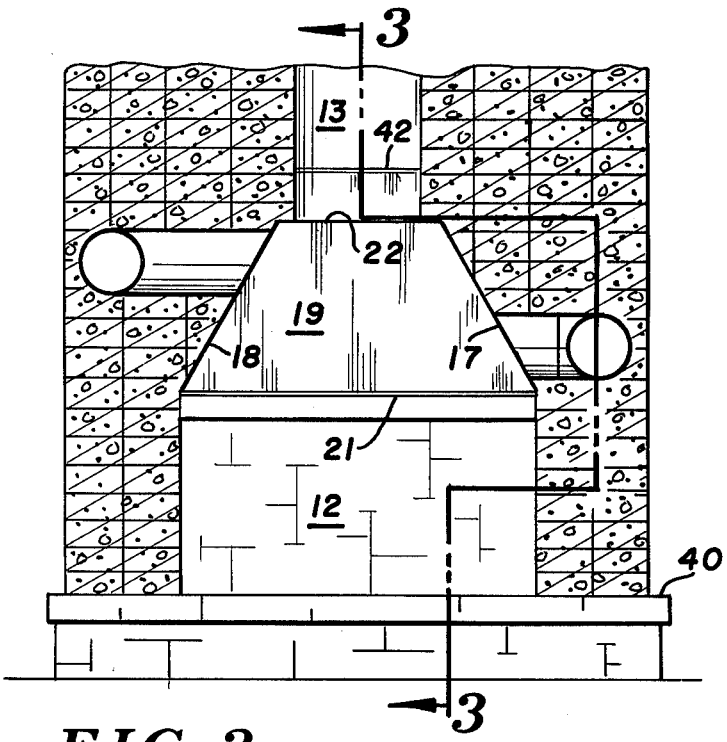
FIG. 2 is a vertical sectional view taken along the line and in the direction of arrows 2—2 of FIG. 1, and illustrating the manner in which the fireplace room heater means of the present invention is installed within the fireplace structure.
Figure 3:
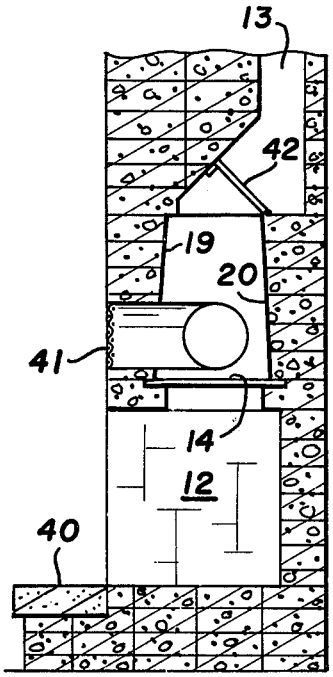
FIG. 3 is a vertical sectional view taken along the line and in the direction of the arrows 3—3 of FIG. 2.
Figure 4:
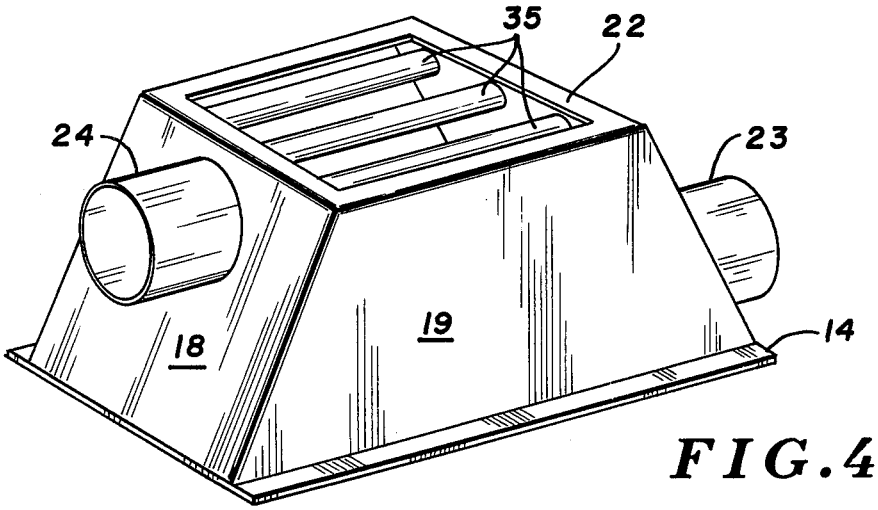
FIG. 4 is a perspective view, on a slightly enlarged scale, illustrating the fireplace room heater means of the present invention.
Figure 9:
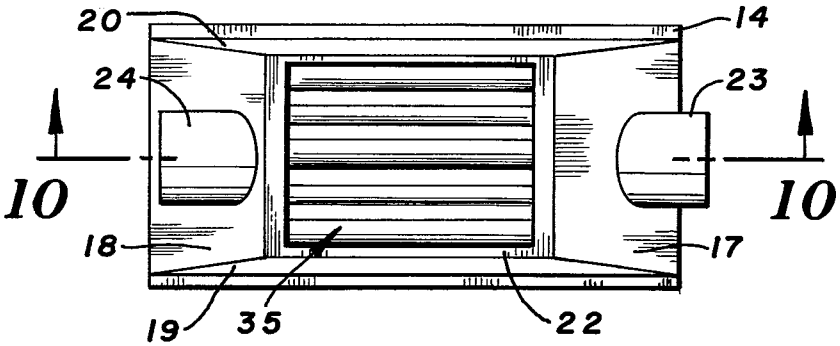
FIGS. 8 and 9 are top and bottom plan views of the room heater means.
Figure 7:
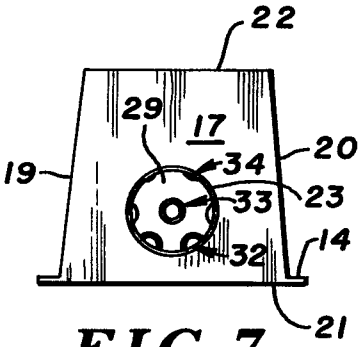
FIGS. 6 and 7 are rear and front elevational views respectively of the room heater means of the present invention.
Figure 5:
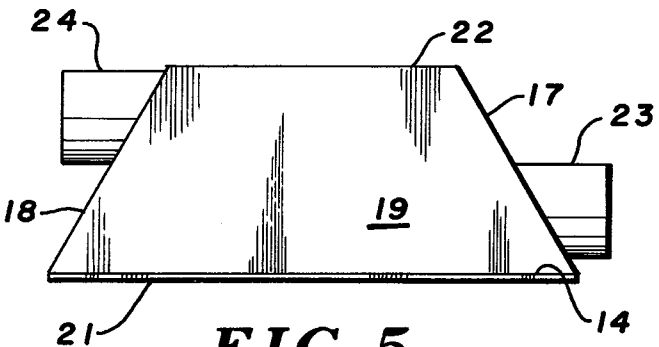
FIG. 5 is a side elevational view of the fireplace room heater means of the present invention.
Figure 8:
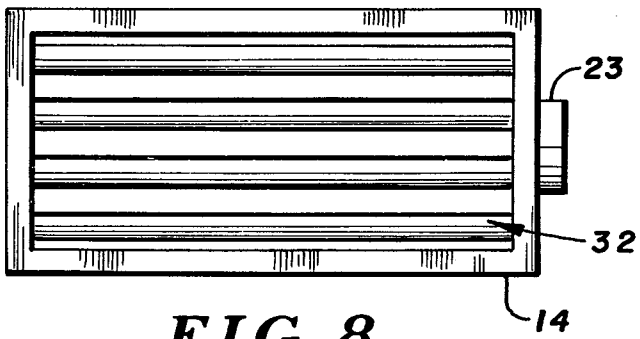
Figure 6:
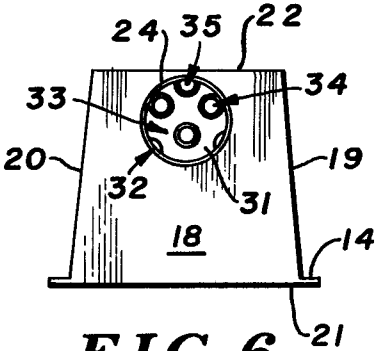

In accordance with the preferred embodiment of the present invention, and with particular attention being directed to FIGS. 1-3 of the drawings, the fireplace room heater means generally designated 10 is shown mounted within a conventional fireplace structure, with the room heater means being secured within the fireplace structure 11 at a point in the flue 13, and generally above firebox 12. Fireplace room heater means 10, as indicated, is generally in the form of a hooded shell. Means are provided for mounting the heater means within the fireplace, particularly as is illustrated by the flange means 14 extending about the exterior of the base of the hooded shell forming the room heater means.

As is apparent, the room heater means comprises an enclosure which is formed of a plurality of generally inclined walls, including a front wall 17, a rear wall 18, and a pair of side walls 19 and 20. The walls, accordingly, extend between and define an open bottom as at 21, and an open top as at 22.

As is apparent in the structure illustrated in FIGS. 1–4, inlet port is provided as at 23, with an outlet port being provided at 24, with the internal arrangements being disclosed more fully hereinafter.

Attention is now directed to FIGS. 5–11 wherein the room heater means is described and defined in greater detail. With particular attention being directed to FIG. 10, it will be observed that the structure includes an inner front wall as at 26, and an inner rear wall as at 27, thereby defining an inlet air manifold chamber as at 28, and an outlet air manifold chamber as at 30. These chambers are within the annular zone or volume defined and confined between outer front wall 17 and inner front wall 26, and between outer rear wall 18 and inner rear wall 27. As is apparent, member 23 provides direct communication between inlet 23 and intake manifold chamber 28 as at opening 29, while outlet 24 provides direct access and communication with exhaust manifold 30 as at 31. As is apparent, inner walls 26 and 27 are spaced apart so as to define a flue zone or area therebetween.

With further attention being directed to FIGS. 5–11 respectively, it will be observed that a plurality of duct means is arranged to extend across the flue area between inner walls 26 and 27, with these duct means being in direct communication with the intake manifold and exhaust manifold respectively. The individual duct means are arranged in generally axially parallel relationship in a plurality of rows, such as the bottom row generally designated 32, the intermediate rows generally designated 33 and 34, and with the top row being generally designated 35. The individual members of the rows are arranged in predetermined stacked and staggered relationship, with the individual members in adjacent rows being axially offset, one from the other. This staggered stacking arrangement is illustrated in certain detail in FIG. 11.

Figure 10:
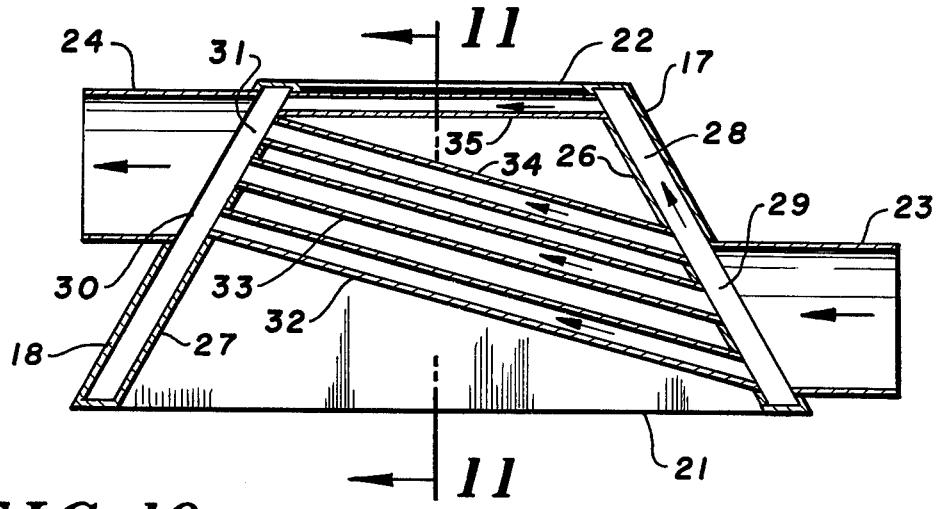
FIG. 10 is a vertical sectional view taken along the line and in the direction of the arrows 10—10 of FIG. 9, and illustrating the air flow path through the structure.
Figure 11:
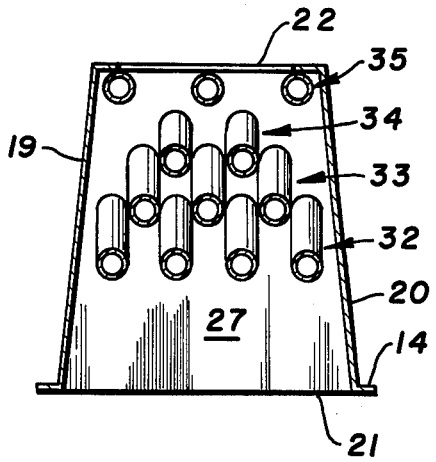
FIG. 11 is a vertical sectional view taken along the line and in the direction of the arrows 11—11 of FIG. 10.

The individual ducts further extend along an inclined axis, as illustrated in FIGS. 10 and 11, with the axis inclining from the intake manifold to the exhaust manifold. Furthermore, the duct or tube axis of the ducts of each of the individual rows is spaced apart vertically a distance generally equal to twice the outer duct diameter. Therefore, interference with or generation of impedance to flow of stack gases is minimized. As is apparent in the drawings, the angle of incline is illustrated as being generally in the area of about 15 degrees, with this angle of inclination having been found to enhance air flow, and maintain the flow at a desired velocity for most applications.

In order to reduce the impedance to normal air flow upwardly from the firebox through the stack, the individual ducts are spaced apart vertically a distance generally equal to twice the outer duct diameter. This vertical spacing together with the staggered relationship has been found to minimize any adverse effects due to increased resistance to air flow within the flue.

Furthermore, in order to provide for mechanical rigidity of the structure, and also to reduce the temperatures within the intake manifold, an upper row of ducts 35 is established which extends generally across and couples the upper portions of the manifolds, one to the other. The duct or tube axis of the individual ducts of the top row are furthermore arranged in offset relationship from the tube or duct axis of the next adjacent row. Thus, enhanced air flow together with a reduction in temperature along the surfaces exposed to the hot gases is normally achieved.

Conventional steel materials of construction may be employed for the apparatus of the present invention. For example, the individual members forming the walls and ducts of the structure may be conveniently fabricated from cold-rolled steel, or other suitable material of construction. For most applications, a wall thickness of approximately ⅛ inch has been found satisfactory.

It will be appreciated that gravity flow will provide for substantial air flow between the intake manifold and the exhaust manifold, however in certain applications it may be desirable to enhance the flow by interposing a fan or other flow inducing element in the system. Generally speaking, however, substantial convection currents may be generated by the structure without relying upon external forces to drive air therethrough.

In a typical fireplace installation, the fireplace structure, normally of brick and the like, it provided as is illustrated in FIGS. 1–3, with a base hearth or the like being shown as at 40. Inlet 23 may be provided with an elbow or the like in order to communicate with the front surface of the fireplace, with the same feature being present in the outlet 24. At any rate, suitable grill work or the like may be provided as at 41, for enhancing the appearance of the system. If symmetry is desired, the individual grills may be provided so as to be arranged generally in horizontal alignment. However, it is desired that the horizontal spacing as illustrated in FIG. 2 between the inlet 23 and outlet 24 be maintained. As is indicated in FIG. 3 the fireplace is typically provided with a damper as illustrated at 42, to control the flow of air through the system. Dampers are, of course, in common use and have been in such common use for many years.

It will be appreciated, therefore, that the fireplace room heater means of the present invention provides a desired system for flow of air through a hooded shell arrangement, with the air flow being strong, and with the increased impedance to flow of stack gases being maintained at a practical minimum.

I claim:

1. Fireplace room heater means comprising:

(a) a generally pyramidal hooded shell member adapted to be mounted in a fireplace flue, said shell member comprising an outer front wall, an outer rear wall and first and second side walls each sloping inwardly and upwardly to define a generally rectangular open bottom and a generally rectangular open top of a smaller perimeter than that of said open bottom and a pair of inner walls including an inner front wall and an inner rear wall, said inner front wall being generally parallel to and spaced apart from said outer front wall to form an intake air manifold therebetween, said inner rear wall being generally parallel to and spaced apart from said outer rear wall to form an exhaust air manifold therebetween, said inner walls being spaced apart from one another to define a flue zone thereacross;

(b) an inlet port in communication with the base portion of said intake manifold, and an outlet port in communication with the upper portion of said exhaust manifold, and a plurality of duct means extending across said flue zone and being in communication with said intake manifold and exhaust manifold respectively;

(c) said duct means being arranged in generally axially parallel relationship in a plurality of rows, with the individual members of each row being arranged in predetermined stacked and staggered relationship relative to the individual members in adjacent rows, and with the individual members in adjacent rows being axially offset, one from the other, said ducts extending along an inclined axis from said intake manifold to said exhaust manifold, and with the duct axis of the ducts of each individual row being spaced apart vertically a distance generally equal to twice the outer duct diameter; and (d) a top row of ducts extending across and coupling the upper portion of said manifolds, one to the other, and with the duct axis of the ducts of said top row being offset from the duct axis of the ducts of the next adjacent row.

2. The fireplace room heater means as defined in claim 1 in that said outer walls are provided with outwardly extending mounting flanges to provide an annular support surface about said open bottom.

* * * * *